United States Patent [19]

Van Eerden et al.

[11] Patent Number: 5,044,931

[45] Date of Patent: Sep. 3, 1991

[54] LOW NOX BURNER

[75] Inventors: John J. Van Eerden; Chad F. Gottschlich, both of Philadelphia; Wayne C. Gensler, Point Pleasant, all of Pa.

[73] Assignee: Selas Corporation of America, Dresher, Pa.

[21] Appl. No.: 592,622

[22] Filed: Oct. 4, 1990

[51] Int. Cl.[5] ..... F23C 5/00

[52] U.S. Cl. ..... 431/8; 431/10; 431/177; 431/284; 431/348

[58] Field of Search ..... 431/8, 10, 174, 177, 431/284, 285, 348

[56] References Cited

U.S. PATENT DOCUMENTS

| | | | |
|---|---|---|---|
| 2,204,719 | 6/1940 | Zink | 431/284 |
| 2,935,128 | 5/1960 | Ferguson | 431/174 |
| 2,965,163 | 12/1960 | Lange et al. | 431/284 |
| 3,179,151 | 4/1965 | Reed | 431/174 |
| 4,257,762 | 3/1981 | Zink et al. | 431/348 |
| 4,842,509 | 6/1989 | Hendrikus | 431/8 |
| 4,874,310 | 10/1989 | Seemann et al. | 431/188 |

FOREIGN PATENT DOCUMENTS

| | | | |
|---|---|---|---|
| 828502 | 2/1960 | United Kingdom | 431/348 |

*Primary Examiner*—Carroll B. Dority
*Attorney, Agent, or Firm*—Austin R. Miller

[57] ABSTRACT

A gaseous fuel burner provides substantial reduction of nitrogen oxide content in the combustion gases by creating a screen of premix combustion products, by introducing secondary gaseous fuel for admixture with the screen, and by exposing secondary air to the mixture for reaction with the secondary gaseous fuel.

19 Claims, 4 Drawing Sheets

LOW NOX BURNER

BACKGROUND OF THE INVENTION

Field of the Invention

This invention relates to a burner, particularly to one for burning a gaseous fuel, and further relates to a method of burning a gaseous fuel in a manner to produce combustion gases having a low content of nitrogen oxide. Hereinafter, nitrogen oxides, which are primarily nitric oxide and nitrogen dioxide, are collectively referred to as "NOx".

Major environmental and other problems have been encountered in the production of flue gases containing high contents of NOx. The NOx tends to react under atmospheric conditions to form environmentally unacceptable conditions, including the widely known phenomena known as urban smog and acid rain. In the United States and elsewhere, environmental legislations and restrictions have been enacted, and more are expected to be enacted in the future, severely limiting the content of NOx in flue gases.

In U.S. Pat. No. 4,874,310, granted Oct. 17, 1989 to Selas Corporation of America, the assignee hereof, a controlled primary air inspiration gas burner was disclosed, in which the introduction of control primary air was controlled in order to provide a substantial reduction of the content of nitrogen oxides in the flue gas. Such a burner includes extra piping for the introduction and control of the primary air, and this sometimes introduces expense and possible complications, especially in furnace installations utilizing a very large number of burners. Other endeavors have been made to reduce the content of NOx in furnace flue gases but many have been found unattractive in view of their requirement of too much operator attention, and in view of the need for extremely attentive control in order to assure that there will be no violation of existing environmental laws. It is very important to be able to obtain a very substantial reduction of NOx content so that even in the event of operator error the environmental law will not be violated and the further operation of the plant and its equipment will not be enjoined by governmental action.

It has been the general indication in the prior art for premix burners that reduced NOx contents can be obtained by avoiding secondary air, by using substantially entirely primary air, and by firing the burner as close as possible to its maximum firing capacity. We have now discovered a surprising exception.

OBJECTS OF THE INVENTIONS

It is accordingly an object of the invention to provide a burner and a method of burning gas wherein exceedingly low NOx contents are obtainable in the exhaust gases. It is a further object of this invention to provide such a burner and method wherein careful, delicate and precise operator control is unnecessary to achieve the desired low NOx flue gas content. Still another object of the invention is to provide such a burner and method wherein the requirements for utilizing substantially 100% primary air, and utilizing a firing rate substantially equal to the maximum available firing rate for the burner, are no longer necessary.

Another object of this invention is to provide a burner which not only provides radically reduced NOx values for the flue gas but which provides very substantially increased burner output capacity.

Other objects and advantages of this invention, including the simplicity, economy and easy operability of the same, and the ease with which burners may be introduced into new furnaces or retro-fitted into existing furnaces, will become apparent hereinafter, and in the drawings of which:

DRAWINGS

DETAILED DESCRIPTION OF THE INVENTION

Figure 2:
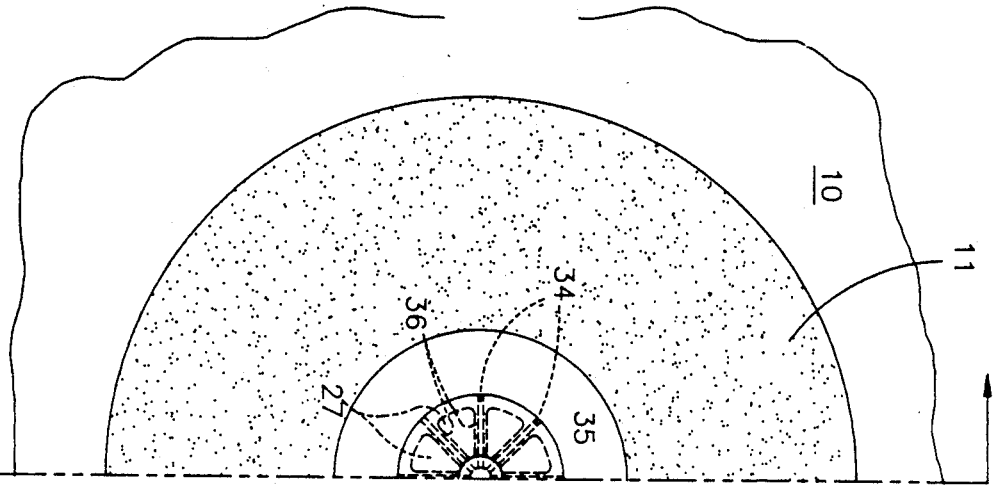
FIG. 2 is a partial end view, slightly enlarged, of the burner of FIG. 1.

It will be appreciated that the following description is intended to refer to the specific forms of the invention selected for illustration in the drawings, and is not intended to define or limit the invention, other than in the appended claims.

In utilizing the terms "primary air" and "secondary air" in this specification it will be understood that the expression "primary air" is intended to be directed to air premixed with the gaseous fuel in the burner, whereas the expression "secondary air" is intended to be applied to air mixed beyond the burner nozzle and not conducted through the body of the burner.

Figure 1:
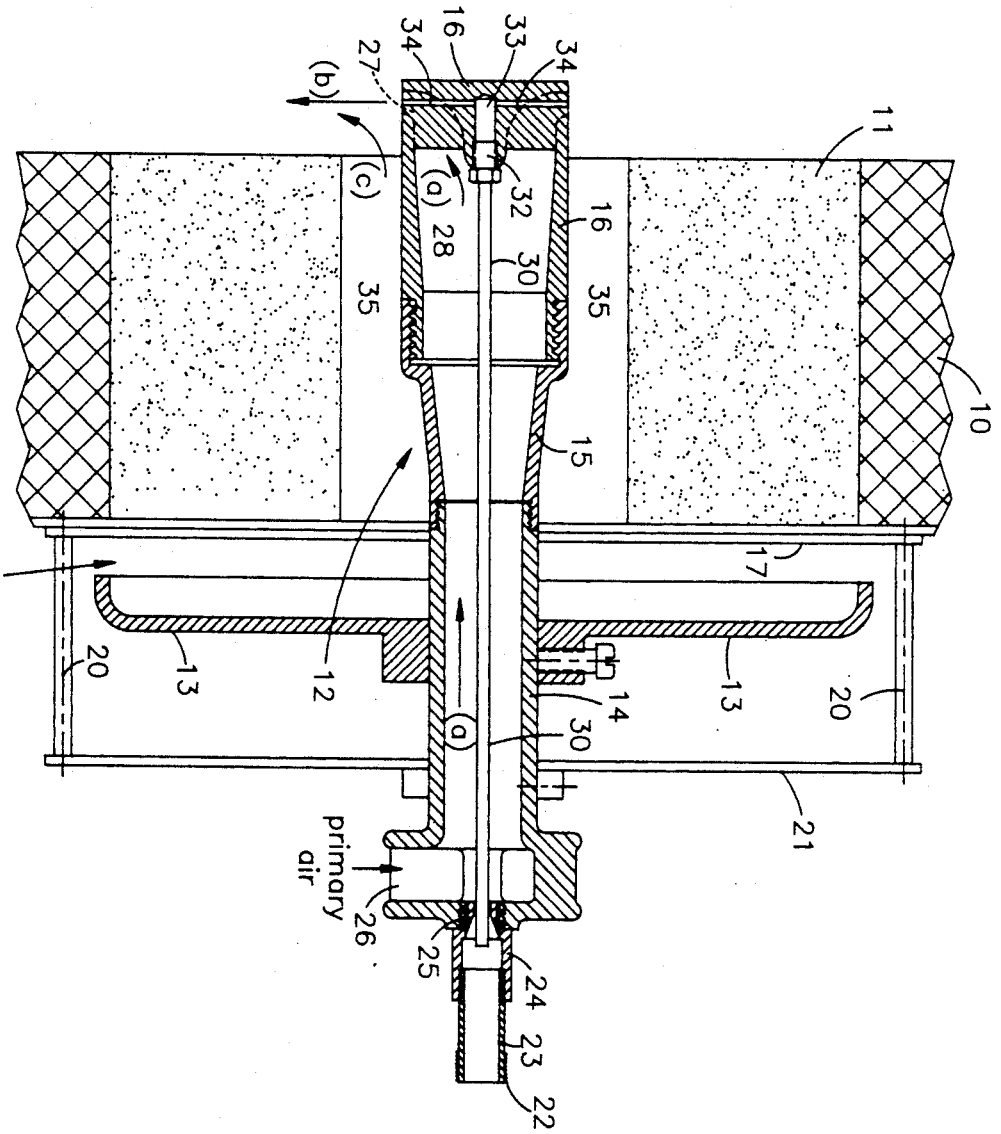
FIG. 1 is a sectional view showing a burner embodying features of this invention.

Turning now to the specific form of the invention illustrated in the drawings, and referring particularly to FIG. 1, the number 10 indicates a furnace wall having an optional burner block 11 forming an opening for insertion of the burner 12. The number 13 designates a secondary air shutter. Tube 14 of the burner 12 is threaded to a burner body expansion portion 15 which in turn is threaded into a burner tip 16. The furnace casing 17, support arms 20 and mounting plate 21 are provided in order structurally to support the burner body tube 14.

Mounted on the inlet end of the burner body tube 14 is a threaded connection 22 for the introduction of a gaseous fuel into an inlet tube 23. Incoming gaseous fuel is conducted through a spud 24 provided with a multiplicity of orifices 25. The orifices form jets of fuel which entrain primary air through the opening 26 by the well known jet effect.

The fuel flowing through the orifices 25, called the primary fuel, mixes with the primary air in order to form a gaseous premix, which is caused to flow in the direction of the arrow (a) within the burner body tube 14, the expansion tube 15 and the premix chamber 28. In the usual manner, the premix is caused to flow through the burner tip 16 and out through the premix ports 27 for combustion within the furnace space at a location close to the inner surface of furnace wall 10 and the burner block 11.

In accordance with this invention, means are also provided for introducing secondary gaseous fuel into the burner tip. A gaseous fuel tube 30 is arranged to receive gaseous fuel within the inlet tube 23. Supported by the spud 24, it extends forwardly to the burner tip, and the secondary gaseous fuel is conducted axially as shown in FIG. 1 of the drawings. At its forward end the secondary gaseous fuel tube 30 is threaded at 32 into the burner tip 16, and communicates with a chamber 33 centrally formed in the burner tip 16. The chamber 33 is in fluid communication with a plurality of passageways 34, 34 which are bored through vanes formed at the tip portion of the burner tip 16, which vanes will be described in further detail hereinafter. In the manner discussed, secondary gaseous fuel is introduced through the gaseous fuel tube 30 into the chamber 33 and outwardly through a multiplicity of passageways 34 into the furnace space immediately adjoining the inner wall of the furnace 10 and the burner block 11.

It will further be appreciated that, in view of the provision of a space 35 between the outer surface of the burner tip 16 and the inner surface of the burner block 11, an annular passageway 35 is provided for the flow of secondary air, which secondary air is provided for the combustion of the secondary gaseous fuel emanating from the passageways 34 into the furnace.

Turning now to FIG. 2, which represents a fragmentary end view of the burner tip, it will be seen that the secondary gaseous fuel passageways 34 are drilled through a plurality of vanes 36 emanating from the central portion of the burner tip and extending outwardly to the periphery of the burner tip 16. The vanes 36 are shaped to provide a plurality of spaced-apart premix ports 27 in the burner tip 16 for the premix. Because of the fact that the vanes 36 diverge from each other they define a divergent path for the flows of premix coming from the burner tip, and cause admixture with the secondary gaseous fuel coming from the secondary gaseous fuel passageways 34.

As is shown in FIG. 1, the flow (a) of premix is accordingly mixed with the flow (b) of the secondary gaseous fuel and the two are eventually mixed with each other and with the flow (c) of secondary air entering through the passageway 35. In the form of the invention shown in FIG. 1, the flows (a) and (b) of premix and secondary gaseous fuel enter the furnace at approximately the same distance away from the inner face of the furnace 10 and the hot face wall of the burner block 11, and the flow of secondary air (c) from the secondary air passageway 35 contacts both the combustion products from the premix and the secondary fuel from the passageways 34. It has been discovered that the presence of the combustion products from the premix tempers the reaction between the secondary gaseous fuel and the secondary air flowing from the passageway 35, and this is an important and advantageous feature of the invention in significantly reducing the NOx content of the resulting combustion products.

Continuing with reference to FIG. 1, the diameters of the passageways 34 and the gaseous fuel tube 30 can be selected in concert with the number and diameter of the orifices 25, to fix the ratio of primary gaseous fuel to secondary gaseous fuel. Since the primary gaseous fuel and the secondary gaseous fuel are provided from the same source, namely inlet tube 23, a change of the diameters of passageways 34 and gaseous fuel tube 30 in concert with the number and diameter of orifices 25 results in a predetermined change of the ratio of primary gaseous fuel to the secondary gaseous fuel. This is an advantageous feature of the invention since it reduces or eliminates the need for precise and individual control on the part of the operator.

Figure 3:
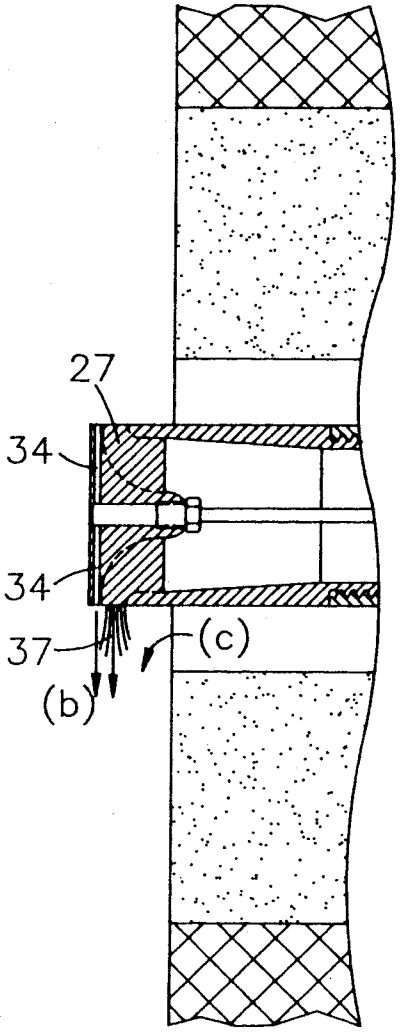
FIG. 3 is a partial sectional view similar to FIG. 1, but showing a modified form of burner in accordance with this invention

Turning now to FIG. 3 of the drawings, parts similar to those in FIG. 1 are similarly numbered and need not be described again, but in FIG. 3 the passageways 34 are located forwardly along the burner tip, farther away from the burner block 11, than are the premix ports 27 of FIG. 1. In this manner the premix combustion products coming from premix ports 27 of FIG. 3 form a combustion products screen 37 interposed between the path (c) of the secondary air and the path (b) of the secondary gaseous fuel. In this configuration the flow of combustion products along the path 37 interferes, at least to some extent, with any immediate admixture of the secondary gaseous fuel flowing in the path (b) and the secondary air flowing in the path (c). This tempers the reaction between the secondary gaseous fuel and the secondary air, thus creating, in a manner not completely or fully understood, to a highly significant and entirely reliable reduction in the nitrogen oxide content of the flue gas resulting from the combustion. Similar effects are obtained, as will be apparent, in the embodiments shown in FIGS. 1 and 2, and the relative spacing inwardly and outwardly of the respective passageways can be varied in a manner to produce particular tempering effects for particular installations and desired combustion product compositions.

Figure 4:
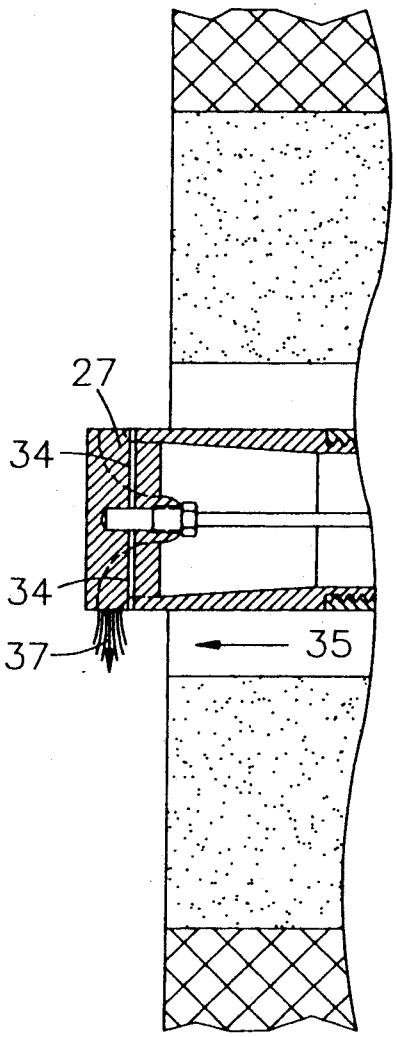
FIG. 4 is another partial sectional view similar to FIGS. 1 and 3, showing still another modified form of burner in accordance with this invention.

Turning now to FIG. 4 of the drawings, it will be seen that the premix ports 27 are located inwardly, farther into the furnace, than are the secondary gaseous fuel passageways 34, 34. While this provides a somewhat closer relationship between the secondary gaseous fuel and the secondary air flowing from the passageway 35, and may in some cases not be preferred, the turbulent effect of the combustion products screen 37 nevertheless tempers the reaction between the secondary gaseous fuel and the secondary air.

Figure 5:
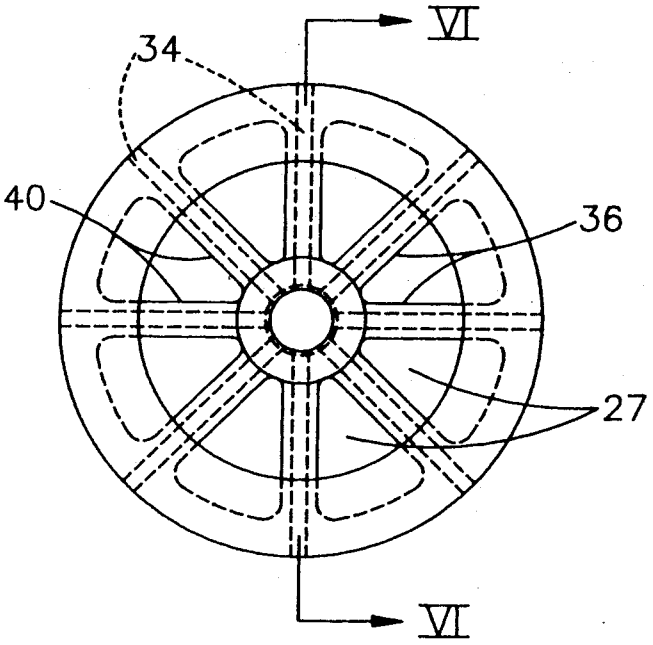
FIG. 5 is an end view of a burner tip embodying features of this invention.

Turning now to FIG. 5 of the drawings, it will be apparent that the burner tip includes a plurality of vanes 36, each carrying a secondary gaseous fuel passageway 34, and that these peripherally extend at spaced-apart locations around the periphery of the burner tip. Similarly, FIG. 5 shows the angular relationship of the sidewalls 40 of the vanes 36.

Figure 6:
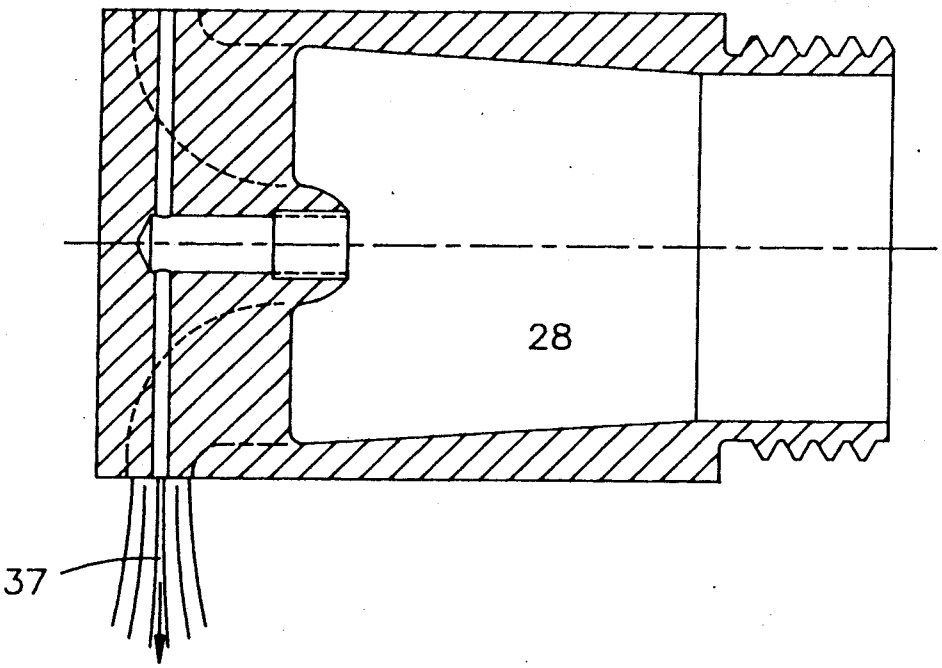
FIG. 6 is a sectional view taken as indicated by the lines and arrows VI—VI which appear in FIG. 5 through the burner tip of FIG. 5.

FIG. 6 shows one particular form of the burner tip, showing the manner in which the premix flow is achieved from the premix chamber 28 to form the combustion products screen 37.

Figure 7:
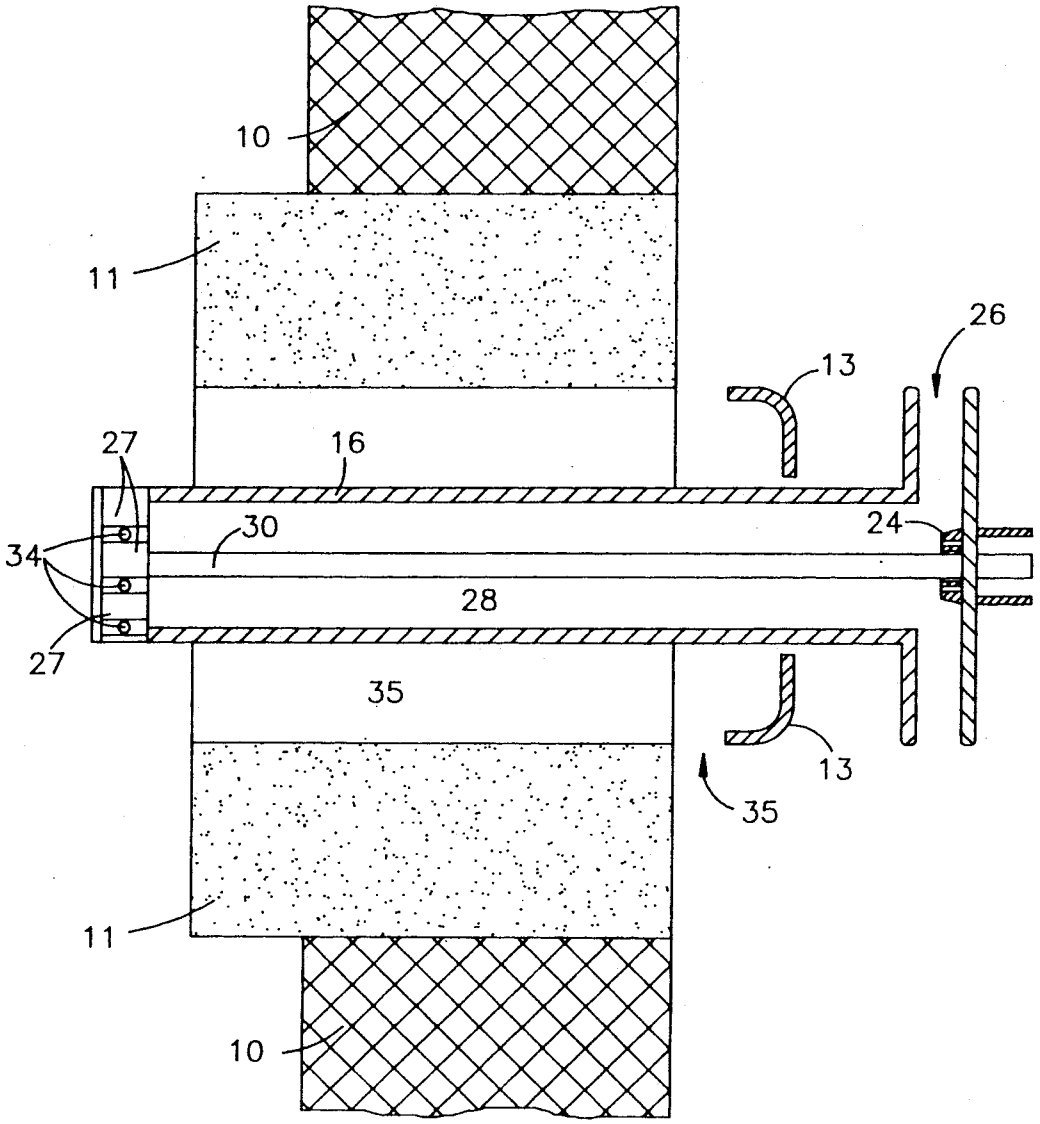
FIG. 7 is a sectional view taken through the furnace wall, showing schematically a modified installation of a burner in accordance with this invention.

FIG. 7 shows a burner structure similar to that of FIG. 1, wherein the hot face of the burner block 11 extends farther into the furnace than does the inner face of the furnace wall 10. This is an important and advantageous feature of the invention. This feature enables the burner tip to be moved more deeply into the furnace, and this surprisingly provides an unexpected reduction of the NOx content of the resulting combustion products. Further, if the burner block 11 and the furnace wall 10 are flush with each other it is difficult to position the burner tip more deeply into the furnace without sacrificing the ability to light the burner in the first instance. It has been surprisingly found that with the invention as shown in FIG. 7 of the drawings it is not only possible to provide a configuration resulting in a significant reduction of nitrogen oxide content in the flue gas, but also that this is readily accomplished without any difficulty in initially lighting the burner. We have observed that it is advantageous to maintain the burner relatively close to the burner block, such as one inch or less, while moving the burner block farther into the furnace wall, and it is this combination which is believed to lower the NOx content of the flue gas without interfering with the ease of lighting of the burner.

Secondary air flow is controlled by the cross-sectional area of the passageway 35, furnace draft, and the position of the secondary air shutter 13.

Although it has been understood from past experience that the use of primary air alone produces lower NOx, it is a surprising advantage of the burner in accordance with this invention that it seemingly inconsistently provides a combination of primary and secondary fuel. This not only surprisingly reduces the NOx content in the combustion gases, but also radically increases the burner capacity even for the same size burner. This is attributable to the fact that secondary gaseous fuel is being burned in addition to the primary gaseous fuel.

It is important in accordance with this invention that the premix introduced through the combustion passageways 27 forms a screen of burned gases which dilute the admixture of secondary gas and secondary air, slowing the secondary fuel reaction rate. It is believed that this act of slowing the reaction rate results in a decreased flame temperature, which in turn results in a lower NOx content in the combustion gases. A substantial amount of a diluted mixture of burned gases and secondary fuel meets the secondary air, and it is believed that this phenomenon occurs before the secondary air can directly and quickly react with the secondary gaseous fuel.

It has been discovered that this invention has another advantage in being surprisingly insensitive to the presence of excess air, so far as the NOx content of the emitted exhaust gas is concerned. In other words, the invention is highly valuable in connection with a furnace having air leaks allowing for the presence of tramp air within the furance chamber. It is believed that the use of a mixture partially composed of nozzle mixed, primary gaseous fuel and primary air, combined with a portion of secondary gaseous fuel and secondary air, provides a more gentle slope to an NOx generation curve wherein NOx generation is plotted against the air-to-fuel ratio. This phenomenon was unexpected but has been found to provide a surprising lack of sensitivity to the presence of undesired excess air, or tramp air, in the furnace chamber.

It is a further and important advantage of the invention, as will now be apparent, that in the operation of burners and in the combustion of gas in accordance with this invention, all of the desired flow rates and ratios can be achieved and constantly held without the continuous control of operating personnel. In this way the achievement of a substantially constant and extremely low NOx ratio in the combustion gas can be achieved independently of any variations that might otherwise be introduced by personnel operating the burners or furnace.

The method of operation of the burner in accordance with this invention will now become apparent. The burner is ignited in the usual manner with the use of the gas supply. By utilizing the inspiration characteristics of the spud 24, primary air is taken in through the primary air passageway 26, and the burner is operated in a manner to introduce combustible premix through the premix ports 27. Concurrently, the gaseous fuel also flows through the secondary gaseous fuel tube 30 and radially outwardly through the secondary gaseous fuel passageways 34. Automatically, and without requiring operator intervention, the secondary gaseous fuel mixes at least partially with a screen of premix or of premix combustion products, and the resulting mixture mixes with the flow of secondary air in a moderate and controlled manner, resulting in combustion of secondary gaseous fuel with secondary air in the environment of the screen of premixed combustion products.

Although this invention has been described with reference to various specific embodiments, it will be appreciated that many variations may be made without departing from the spirit and the scope of the invention. For example, various jet nozzle configurations may be resorted to, utilizing various numbers of passageways for the gas supply and for the supply of air, and with either gas or air passages surrounding the other. For example, various arrangements may be made with regard to the sizes and shapes of the passageways 27, 34, and even the secondary air passageways 35. While the secondary gaseous fuel tube 30 has been shown as centrally and axially arranged, it will be apparent that a wide variety of other arrangements may be resorted to. Further, instead of generating a primary fuel, primary air premix at the burner, premix already formed elsewhere may simply be directed into the premix chamber 28 of the burner tip.

The invention also applies to unidirectional burners projecting combustion products in a confined path, as well as 360 burners of the type illustrated in FIG. 5 of the drawings.

The use in the claims of the word "wall" is not intended to be limited to a vertical wall but applies as well to floor or roof surfaces, or to slanting or walls otherwise arranged.

As will be apparent, any number and variety of shapes of primary air ports may be provided, as well as inlets for secondary air, and burners may be provided with or without the utilization of a secondary air shutter or secondary air passage, so long as a passageway such as passageway 35 is provided for delivery of secondary air to the burner tip. Many other variations may be made, as will be apparent to those skilled in the art, all without departing from the spirit and scope of this invention as defined in the appended claims.

We claim:

1. A gaseous fuel burner comprising a burner body having a burner tip installed in a wall of a furnace or the like for combustion of gaseous fuel therein, a primary supply means for introducing a primary gaseous fuel and primary air forwardly along said burner body and said burner including means at said tip for discharging a mixture of said fuel and air in a direction to form a combustion gas screen extending substantially parallel with and along an inner surface of said furnace wall;

secondary air supply means forming a secondary air passage extending along said burner body and having a secondary air outlet opening which is at a location spaced from said means for discharging said fuel and air, and secondary gaseous fuel supply means forming a secondary gaseous fuel passageway extending along said burner body and having an outlet opening means at said burner tip for discharging said secondary fuel in a direction extending substantially concurrently with said mixture of fuel and air and along an inner surface of said furnace wall, whereby at least some mixing occurs at the burner tip between said combustion gas screen and the incoming secondary air before said secondary air undergoes combustion with said secondary gaseous fuel, whereby said burner produces combustion gases of reduced nitrogen oxide content.

2. The burner defined in claim 1 wherein said burner tip includes a primary outlet opening for releasing said primary gaseous fuel and primary air or mixtures into said furnace, and wherein said secondary fuel supply outlet opening is closer to the end of the burner tip than is said primary outlet opening.

3. The burner defined in claim 1 wherein said burner tip includes a primary outlet opening for releasing said primary gaseous fuel and primary air or mixtures into said furnace, and wherein said secondary fuel supply outlet opening is at about the same distance from the end of said burner tip as is said primary outlet opening.

4. The burner defined in claim 1 wherein said burner tip includes a primary outlet opening for releasing said primary gaseous fuel and primary air or mixtures into said furnace, and wherein said secondary fuel supply outlet opening is farther from the end of the burner tip than is said outlet opening.

5. The burner defined in claim 1 wherein both said primary and secondary gaseous fuel supply means are connected to a common source.

6. The burner defined in claim 5 wherein control means are provided in said primary and secondary fuel supply means to control the relative rates of supply of said primary and secondary gaseous fuels to said burner.

7. The burner defined in claim 6 wherein said control means includes passageways of controlled sizes relative to each other.

8. The burner defined in claim 1 wherein said secondary fuel supply means includes a longitudinally arranged supply tube extending lengthwise of said burner and a plurality of connecting passages extending crosswise of said burner tip.

9. The burner defined in claim 1 wherein said primary air supply means includes an inspiration nozzle adapted to premix said primary gaseous fuel and said primary air.

10. In a furnace for burning a gaseous fuel, said furnace having a wall with inner and outer wall surfaces and a burner extending through said wall into such furnace for burning gaseous fuel with reduced production of nitrogen oxides in the resulting combustion flue gas, the combination which comprises:

(a) a burner block extending through said furnace wall surrounding said burner with intervening space between said burner block and said burner for flow of secondary air;

(b) said burner block having a hot face which extends into said furnace beyond said inner wall of said furnace;

(c) said burner having a tip which extends into said furnace beyond said hot face of said burner block;

(d) means at said burner tip for providing a combustion gas screen directed generally along said hot face of said burner block; and (e) means at said burner tip for introducing a separate flow of secondary gaseous fuel for flow generally along said hot face of said burner block, whereby said secondary gaseous fuel is mixed with both said combustion gas screen and the incoming secondary air from said intervening space.

11. The furnace defined in claim 10 wherein said burner block is composed of high-temperature material.

12. The furnace defined in claim 10 wherein said burner includes a supply of primary air and of primary gaseous fuel and further includes a supply of secondary gaseous fuel and secondary air.

13. The furnace defined in claim 10 wherein said burner tip and said means (d) are so positioned on said burner that at least some mixing occurs among the primary gaseous fuel, the primary air and the secondary gaseous fuel before said secondary gaseous fuel undergoes substantial combustion with said secondary air.

14. The burner defined in claim 10 wherein the burner is provided with a tip having an end spaced from the furnace wall, said tip having a primary outlet opening positioned for releasing primary gaseous fuel and primary air or mixtures into said furnace, and wherein said tip has a secondary fuel supply outlet opening positioned closer to the end of said burner tip than is said primary outlet opening.

15. The burner defined in claim 10 wherein the burner is provided with a tip having an end spaced from the furnace wall, said tip having a primary outlet opening positioned for releasing primary gaseous fuel and primary air or mixtures into said furnace, and wherein said tip has a secondary fuel supply outlet opening positioned at about the same distance from the end of said burner tip as is said primary outlet opening.

16. The burner defined in claim 10 wherein the burner is provided with a tip having an end spaced from the furnace wall, said tip having a primary outlet opening positioned for releasing primary gaseous fuel and primary air or mixtures into said furnace, and wherein said tip has a secondary fuel supply outlet opening positioned farther from the end of the burner tip than is said primary outlet opening.

17. In a method of heating a furnace with a gas burner located adjacent to a furnace wall, to provide a reduced percentage of nitrogen oxide components in the furnace flue gas, the steps which comprise:

(a) burning a mixture of primary gaseous fuel and primary air in said furnace;

(b) guiding the products of combustion of step (a) to form a combustion gas screen directed generally along a portion of said furnace wall adjacent to said burner;

(c) introducing a separate flow of secondary gaseous fuel in a path also directed toward the area along said portion of said furnace wall; and (d) introducing secondary air along said burner, whereby said secondary air is contacted by and at least partially mixed with said combustion gas stream as said secondary air moves into position to react with said secondary gaseous fuel.

18. The method defined in claim 17, wherein the secondary gaseous fuel path is spaced farther from said furnace wall than is the primary gaseous fuel path.

19. The method defined in claim 17, wherein said secondary air is introduced, relative to said furnace wall, at a location closer than said primary gaseous fuel path.

* * * * *